United States Patent [19]

Dietzell et al.

[11] Patent Number: 4,627,346

[45] Date of Patent: Dec. 9, 1986

[54] ROTATIVE PRINTING PROCESS AND APPARATUS FOR CARRYING OUT SAID PROCESS

[75] Inventors: Hans-Peter Dietzell, Rosenheim-Aisingerwies; Friedrich Kratzert, Stephanskirchen, both of Fed. Rep. of Germany

[73] Assignee: Niedermayr Papierwarenfabrik AG, Rosenheim, Fed. Rep. of Germany

[21] Appl. No.: 830,712

[22] Filed: Feb. 18, 1986

Related U.S. Application Data

[63] Continuation of Ser. No. 627,348, Jul. 3, 1984, abandoned, which is a continuation of Ser. No. 581,210, Feb. 22, 1984, abandoned, which is a continuation of Ser. No. 338,937, Jan. 12, 1982, abandoned.

[30] Foreign Application Priority Data

Jan. 16, 1981 [DE] Fed. Rep. of Germany ..... 3101243

[51] Int. Cl.[4] ..... B41M 1/10

[52] U.S. Cl. ..... 101/170; 101/348; 101/350; 101/426

[58] Field of Search ..... 101/153, 157, 169, 170, 101/331, 350, 363, 364, 367, 426, 216, 245, 348

[56] References Cited

U.S. PATENT DOCUMENTS

| | | | |
|---|---|---|---|
| 3,986,874 | 10/1976 | Marsh | 101/363 X |
| 4,057,012 | 11/1977 | Heidemann | 101/153 |
| 4,152,986 | 5/1979 | Dadowski et al. | 101/170 X |
| 4,292,104 | 9/1981 | Heimbach et al. | 101/170 X |

OTHER PUBLICATIONS

*Flexography Principles and Practices,* Third Edition, 1980, pp. 1–20, 149–183, and 399.

*Primary Examiner*—Edgar S. Burr
*Assistant Examiner*—Moshe I. Cohen
*Attorney, Agent, or Firm*—Ladas & Parry

[57] ABSTRACT

In a rotative printing process, especially in flexographic printing and indirect gravure (plate) printing, heat is supplied to the solvent containing printing ink so as to evaporate a portion of the solvent and ensure a reliable emptying of the screen-roller cups or the gravure printing cylinder recesses, whereupon, upon cooling the droplets of ink, there is again obtained a higher viscosity which is advantageous for effecting a print with sharp contours and stable forms.

13 Claims, 4 Drawing Figures

Fig.1
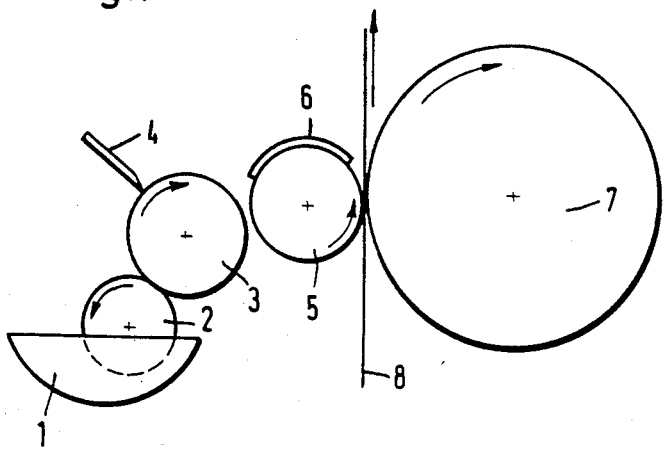
Fig.2
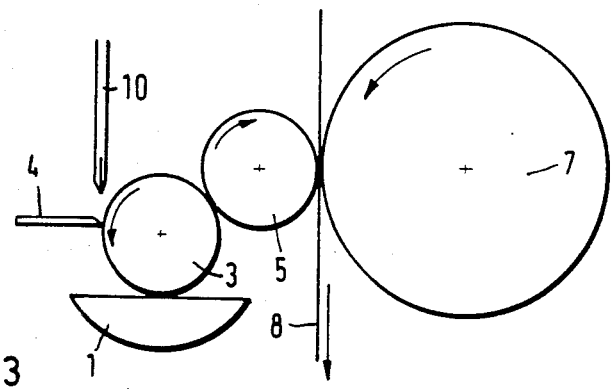
Fig.3
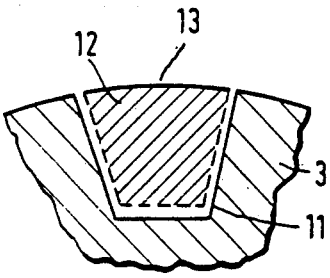
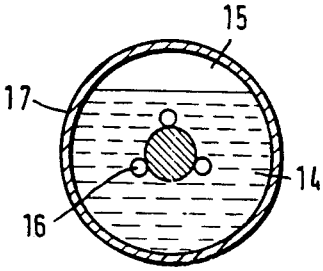
Fig.4

ROTATIVE PRINTING PROCESS AND APPARATUS FOR CARRYING OUT SAID PROCESS

The present application is a continuation of U.S. patent application Ser. No. 627,348 filed July 3, 1984, abandoned, which, in turn, is a continuation of Ser. No. 581,210 filed Feb. 22, 1984, abandoned, which, in turn, is a continuation of Ser. No. 338,937 filed Jan. 12, 1982, abandoned.

The invention relates to a rotative printing process; it especially relates to flexographic printing and indirect gravure (plate) printing.

In the case of flexographic printing and indirect gravure printing, a coloring matter of relatively low viscosity, having a high content of easily volatile solvents, is with the help of auxiliary means transferred to a printing form and therefrom to a printing carrier. The use of such known solutions represents a compromise because the requirements to achieve an efficient operation at high speeds and a high printing quality are partly inconsistent. Thus, for example, by means of a high content of easily volatile solvents, the viscosity of the coloring matter is kept low in order to facilitate the distribution up to the application to the printing carrier, to favor an emptying of the cups on the gravure printing cylinder or on the screen roller in the case of flexographic printing, and to retain the afterwards necessary drying modes and the expendable drying energy within an adoptable limit. At the same time, however, the low viscosity results in that the droplets of ink, which during the process have been removed from the cups on the gravure printing cylinder cannot be transferred with sharp contours and stable dimensions with consequential blurring due to point growth. Moreover, the desire to avoid coloring matters of low viscosity discourages the replacement, desired by aspects of environmental protection and safety, of easily volatile solvents by difficultly evaporable fluid media, such as water.

It is the object of the invention to develop a rotative printing process in such a way that despite high printing speeds a point of sharp contours and intense color with the least possible point growth is obtained on the printing carrier.

The object is achieved through the features of claim 1. The droplets of ink cool on their way to the printing carrier and on the printing carrier itself to such an extent that there is reached a higher viscosity, bringing about a sharp-contour and dimension-stable printing with only a small point growth.

Indeed, it is well-known in offset printing to reduce the viscosity of a printing ink not containing thinning agents by heating; however, in this way the ink is also printed at elevated temperatures; in doing so all the ink transfer elements of the offset machine starting from the inkwell must be kept warm. According to the invention, however, the ink is permitted to cool after it is emptied from the screen cups or is additionally cooled by means of a cooling device.

Furthermore, in the process according to the invention it is possible to use a printing ink containing fluid media which are difficult to evaporate instead of easily volatile solvents; in addition, said fluid media are not flammable or only hardly flammable. Thus, for example, during the printing process there may be used water-colors, whereby through the heating of the printing ink the fluid constituents are evaporated at least to some extent. In this way the drying of the finished print is also favored.

Further advantageous developments of the invention are defined in the dependent claims and the following specification.

Exemplary embodiments of the invention are hereinafter closer illustrated by means of the drawings.

FIG. 1 is a diagrammatic view of an inking device for flexographic printing;

FIG. 2 shows an inking device for indirect gravure (plate) printing;

FIG. 3 shows a cup with a droplet of ink therein in a partial section of a screen roller or a gravure printing cylinder; and FIG. 4 is a diagrammatic section through a heatable screen or gravure printing roller.

In FIGS. 1 and 2 an ink tank containing printing ink is designated by 1. In the case of flexographic printing according to FIG. 1, the printing ink is taken up from the ink tank by means of a dip roller 2, while in the case of indirect gravure printing according to FIG. 2, the ink is supplied to the printing device by means of an inking nozzle 10, and ink tank 1 is only used for collecting excess ink. In the case of flexographic printing, the printing ink is transferred from the dip roller to a screen roller 3 having cups 11 (FIG. 3) distributed over the surface thereof, said cups containing the ink. The surface of the screen roller 3 is wiped by means of a blade 4 so that there is no ink on the spacing material between the cups 11. In the case of an indirect gravure printing process according to FIG. 2, the same procedure takes place with cylinder 3, which is at least partly provided with screen cups. Said cylinder is further designated as a screen roller.

In the case of flexographic printing (FIG. 1), the droplets of ink 12, which are in the cups 11, must be transferred to a printing plate 6 which is mounted on a block cylinder 5, the printing ink being directly transferred from said printing plate 6 to printing carrier 8. In the case of indirect gravure printing (FIG. 2), the droplets of ink 12 are first transferred from the cups 11 of a screen roller 3 to a block cylinder 5 which applies said droplets to the printing carrier 8. An inking (impression) roll is designated in the Figures with 7.

The screen rollers 3, which are provided with cups 11, are heatable so that the droplet of ink 12 is at least in the area of the contact surfaces so much heated at the walls of a cup 11 that the droplet 12 detaches easily and entirely from the cup when the surface 13 of the droplet comes into contact with the block cylinder 5 or the printing plate 6.

The heating of screen rollers 3 may take place by means of electrical heating elements which are built into the roller body close to the surface and are controlled by temperature probes so that a predetermined temperature is constantly maintained.

According to another development, the heated rollers may be formed as double jacket rollers or hollow cylinders through which there flows a heated fluid medium, for example, thermooil or water, the temperature of which is controlled in dependence on the surface temperature of the screen roller 3.

As an embodiment which on the one hand is distinguishable by small structural expenses during heat supply and a slight susceptance to failure and, on the other hand, ensures a good and as much as possible uniform heat distribution, there is provided a hollow screen roller 3 according to FIG. 4 which is entirely or to some extent filled, for example, with thermooil 14 in its interior. According to the shown practical Example there is provided a partial filling so that there remains an air space 15 which is provided for an equalization of pressure and thoroughly mixes the thermooil 14 during rotation; in so doing wetting of the entire inner surface of the jacket 17 is ensured. For heating the fluid 14 there are arranged electrical heating rods 16 running axially, said heating rods being controlled by temperature probes not shown in the drawing.

Heat is supplied to the ink droplets 12 contained in the engraved cups 11 through the heated surface of the roller, owing to which the fluid constituents of the ink are evaporated. The heat supply brings about a good and nearly complete elimination of the ink droplet from the cup, whereby after being eliminated, the ink droplet again gives off its heat to the cooler environment and becomes more viscous. This results in the achievement of sharpedged single points being transferred with little growth and having a low content of still removable fluid constituents.

The cooling of the ink droplets which are situated on block cylinders 5 can be accelerated by an additional cooling, for example, by blowing cooling air against the block cylinders 5. However, it is also possible to keep the block cylinders 5 at a suitably low surface temperature by means of a cooling medium flowing through the cylinders.

If instead of an ink having a small fluid constituent content there is used a printing ink which for reasons of better transportation and ink dispersion has above all a relatively large fluid constituent content, for example, a water-color, a portion of the fluid constituents will be evaporated through the heat supply. When the fluid constituents are thus evaporated, there is achieved a remaining effect of a higher viscosity.

The employed printing ink is usually filled up in canisters and is at room temperature. In order to facilitate delivery to the screen roller 3 and a uniform dispersion, and eventually to moderate too great a difference in temperature between the surface of the roller and the ink, it is advisable to preheat the ink by means of the apparatus elements which are before the rollers 3 and/or preheat the ink in the ink canister. All contact surfaces, with which the printing ink is in contact, are of importance for said heat supply. These may be conduits, the ink tank 1, or other distribution and/or transfer elements.

The surface temperature of the heated rollers or the heating of the printing ink depends on the type of the ink used, the viscosity and temperature thereof, the technical characteristics of the printing machine, the speed and such like. It can vary in wide ranges and can easily be empirically determined for the actual conditions. Instead of or also in addition to the described heat supply by means of heating the apparatus elements, the printing ink can also be heated by exposure to radiation, for example, by means of I.R. or microwaves. Thereby the surface of the screen rollers 3 is preferably heated. Especially in relation to heating by means of infrared radiation, during which also the surface 13 of the ink droplets 12 reaches a low viscosity, it may be advantageous to cool the block cylinder 5 or the printing carrier 8 per se in order to achieve a binding and form-stabilizing effect at the surface 13 of the ink droplets.

We claim:

1. A rotative printing process which comprises delivering printing ink diluted with a solvent to a rotating cylinder, said cylinder having a cylindrical surface with cups on said surface, said cups receiving said ink, said ink having a viscosity sufficiently low for ready delivery to said cups, and heating the printing ink after it is delivered to said screen cups so as to increase the temperature of the ink while in said cups by an amount sufficient to evaporate a portion of said solvent so as to increase the viscosity of said ink, and removing the ink from the surface of said cylinder between said cups, and transferring the ink only from said cups to a printing carrier to provide distinct points on the printing carrier, each said point corresponding to the ink transferred from one respective cup, said ink being allowed to cool during the transfer from the cups to the printing carrier, the partial evaporation of the solvent serving to minimize point growth on the carrier by increasing the viscosity of the ink.

2. A process according to claim 1, which includes wiping the cylindrical surface so as to remove ink between said screen cups before transferring the ink from said cups to the printing carrier.

3. A process according to claim 1, wherein accelerated cooling of the ink is effected during the transfer of the ink to the printing carrier.

4. A process according to claim 1, wherein the heat is supplied to the printing ink by heating the cylinder having the cups.

5. A process according to claim 1, wherein heat is supplied to the printing ink by exposure to radiation.

6. A process according to claim 1, in which a water-color is used as the printing ink.

7. A process according to claim 1, in which the ink from said cups is first transferred to an intermediate cylinder, said intermediate cylinder transferring the ink thus received as distinct points on the surface of said intermediate cylinder to the printing carrier.

8. In a flexographic printing process which comprises delivering a solvent-containing ink to a rotating cylinder, said cylinder having a cylindrical surface with cups on said surface, said cups receiving said ink, said ink having a viscosity sufficiently low for ready delivery to said cups, removing the ink from the surface of said cylinder between said cups and transferring the ink only from said cups to a printing plate, and transferring ink from said printing plate to a printing carrier, the improvement which comprises heating the printing ink after it is delivered to said screen cups so as to increase the temperature of the ink while in said cups by an amount sufficient to evaporate a portion of said solvent, said ink being allowed to cool during the transfer from the cups to the printing carrier via the printing plate, the partial evaporation of the solvent serving to increase the viscosity of said ink and thus to minimize the point growth on the carrier.

9. A process according to claim 8, in which the cylinder with the cups is a screen roller.

10. A process according to claim 9, wherein the ink is transferred from the screen roller to the printing plate, which rotates, said rotating printing plate then transferring the ink image to the printing carrier, accelerated cooling of the ink being effected while the ink image is on the rotating printing plate.

11. A process according to claim 8, in which a water-color is used as the printing ink.

12. A process according to claim 8, wherein the heat is supplied to the printing ink by heating the cylinder having the cups.

13. A process according to claim 8, wherein the heat is supplied to the printing ink by exposure to radiation.

* * * * *